United States Patent [19]

Hoffman et al.

[11] 4,272,955

[45] Jun. 16, 1981

[54] DIFFUSING MEANS

[75] Inventors: Jacob S. Hoffman, Ipswich; Mario E. Abreu, South Peabody, both of Mass.

[73] Assignee: General Electric Company, Lynn, Mass.

[21] Appl. No.: 53,121

[22] Filed: Jun. 28, 1979

[51] Int. Cl.[3] ..... F02C 3/08

[52] U.S. Cl. ..... 60/39.36; 60/751

[58] Field of Search ..... 60/39.36, 751

[56] References Cited

U.S. PATENT DOCUMENTS

| | | | |
|---|---|---|---|
| 3,364,678 | 1/1968 | Alford | 60/39.65 |
| 3,631,674 | 1/1972 | Taylor | 60/39.36 |
| 4,100,732 | 7/1978 | Bryans et al. | 60/39.36 |

*Primary Examiner*—James J. Gill

*Attorney, Agent, or Firm*—Henry J. Policinski; Derek P. Lawrence; Donald W. Walk

[57] ABSTRACT

A diffuser is provided for achieving efficient conversion of the dynamic head associated with pressurized fluid into static pressure. The diffuser includes structure for reducing the boundary layer accumulated by the fluid during flow in the diffuser and for turning the fluid within the diffuser flowpath.

18 Claims, 2 Drawing Figures

DIFFUSING MEANS

BACKGROUND OF THE INVENTION

This invention relates to diffuser means and more particularly, in one form, to diffuser means disposed between the compressor and combustion sections of a gas turbine engine.

Typically, gas turbine engines include a compressor section which delivers pressurized air to a continuous flow combustor. The pressurized air is mixed with fuel in the combustor, burned and gaseous products of combustion are then exhausted from the combustor to a turbine which extracts energy from the gases. This invention is most applicable to gas turbine engines wherein an annular combustor is comprised of inner and outer combustor liners, defining a combustion chamber or flow path therebetween, and inner and outer walls spaced from the inner and outer liners respectively. Each of the walls define, with its respective liner, a flow path adjacent the combustion flow path. These three flow paths are annular and generally concentric with one another. Pressurized air discharged from the compressor is directed through a divergent, annular passageway commonly known as a diffuser. From the diffuser, the air stream is divided and directed into the aforementioned flow paths. Combustion is maintained in the central flow path between the combustor liners, while the outer flow paths provide air for cooling the combustor liners and additional or dilution air for enhancing combustion within the combustion flow path.

The aforementioned diffuser is provided for purposes of converting the dynamic head of pressurized fluid, in the form of air, exiting the compressor into static pressure. Ideally, it is desirable to convert the dynamic head into static pressure without any loss in total pressure. However, the efficiency or effectiveness of diffusers known in the art is less than satisfactory. Diffusers have been generally classified in two basic categories: step diffusers and controlled diffusers. Typical prior art step diffusers have a gradual expansion portion, during which approximately 60% of the dynamic head is converted into static pressure, and a sudden dump portion, during which only 25% of the remaining dynamic head is recovered. In present day gas turbine engines, where the dynamic head exiting the compressor amounts to 6% of the total pressure, the gradual expansion portion of the step diffuser would recover approximately 3.6% of the dynamic head while the dump portion of the diffuser would recover approximately 0.40% of the dynamic head. Hence, approximately 2.0% of total pressure would be lost. However, in present day engines this degree of loss of total pressure has more or less been found to be satisfactory.

In some of the next generation of advanced gas turbine engines, the dynamic head of pressurized air exiting the compressor is considerably greater than the dynamic head associated with present day engine. In some advanced engines, the dynamic head can approximate 12% to 18% of the total pressure. Fixed geometry non-bleed systems typically maintain a constant $\Delta P/Q$ thus resulting in a loss of between 4.0% and 6.0% in total pressure. With conventional step diffusers, the loss of total pressure in advanced engines, then, may be approximately 2 to 3 times as great as the loss in total pressure associated with present day engines. Hence, prior art step diffusers will not meet the needs of next generation gas turbine engines.

Prior art controlled diffusing techniques are not sufficient in meeting the requirements of next generation gas turbine engines, having high dynamic fluid pressure heads at the compressor outlet, principally because of the formation of a boundary layer at the walls of the diffuser. Since the degree of divergence of the walls is relatively fixed to avoid fluid separation, the larger dynamic head requires a greater diffuser length resulting in an increase in the thickness of the boundary layer along the wall as the fluid flows through the additional length of the diffuser. Increasing boundary layer thickness reduces the efficiency of the diffuser. The present invention is addressed toward these difficulties associated with boundary layer losses found in conventional diffusers. The present invention also address the problem associated with turning the stream of pressurized fluid from the diffuser into the aforementioned concentric flow paths.

Therefore, it is an object of the present invention to provide a diffuser for use in a gas turbine engine.

It is another object of the present invention to provide a diffuser offering increased efficiency or effectiveness over diffusers heretofore known in the art.

It is yet another object of the present invention to provide a diffuser well adapted to cooperate with advanced compressors to efficiently convert the dynamic head of fluid received from the compressor into static pressure.

It is still another object of the present invention to provide means for turning the stream of fluid from the diffuser into concentric flow paths associated with the combustor of a gas turbine engine.

SUMMARY OF THE INVENTION

Briefly stated, these and other objects, as well as advantages, which will become apparent hereinafter, are accomplished by the present invention which, in one form, provides diffusing apparatus for converting the dynamic head of a flowing stream of fluid discharged from a compressor into static pressure. First diffusing means receive fluid from the compressor and decelerate the fluid from a first velocity to a second velocity. Accelerating means disposed downstream of the first diffusing means for accelerating the fluid to a third velocity having a magnitude greater than the magnitude of the second velocity. Second diffusing means are provided downstream of the accelerating means for decelerating the fluid from the third velocity to a fourth velocity having a magnitude less than the magnitude of the second velocity. Means may be provided downstream of the second diffusing means for suddenly expanding the fluid to reduce the velocity of the fluid to a fifth velocity having a magnitude less than the magnitude of the fourth velocity. Step means may be disposed between the first diffusing means and the accelerating means for turning the fluid stream from a first direction to a second direction and for reducing the boundary layer thickness accumulated by said fluid while flowing in the first diffusing means.

DESCRIPTION OF THE DRAWINGS

While the specification concludes with claims distinctly claiming and particularly pointing out the invention described herein, the invention is more readily understood by reference to the description hereinafter set forth and the accompanying drawings in which:

DESCRIPTION OF THE PREFERRED EMBODIMENT

Figure 1:
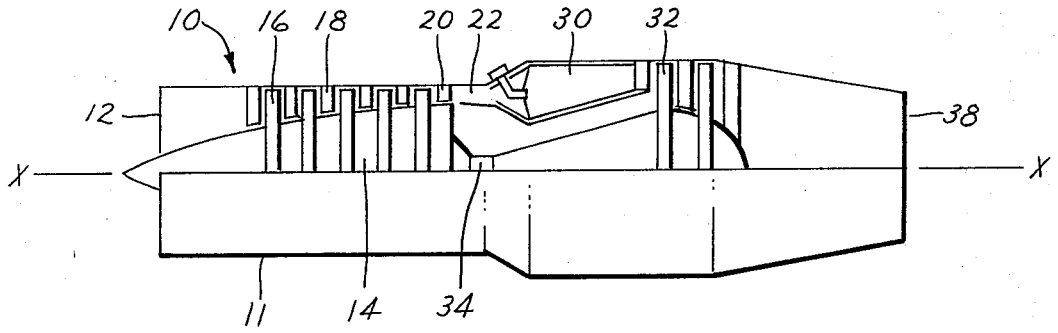
FIG. 1 is a schematic representation of gas turbine engine to which the present invention is applicable.

Referring now to FIG. 1, a gas turbine engine is depicted generally at 10 and includes an outer housing 11, having an inlet end 12 receiving air which enters a multi-stage axial flow compressor 14. Compressor 14 includes a plurality of rows of rotor blades 16 interspersed between a plurality of rows of stator blades 18. The stator blades 18 are affixed at one end to the inner surface of housing 11. At the downstream end of the compressor, a row of compressor outlet guide vanes 20 are disposed, followed by an annular diffuser indicated generally at 22. The diffuser 22 discharges the pressurized air into a combustor, indicated generally at 30, from whence the heated gases exit at high velocity through the power turbine 32. The power turbine 32 extracts work to drive the compressor 14 by means of a connecting shaft 34 upon which the power turbine 32 and compressor 14 are both mounted. The hot gas stream leaving the turbine 32 is discharged to atmosphere through a nozzle 38 thus providing thrust to the engine. Any further description of the general structure and operation of the gas turbine engine, depicted in FIG. 1, is deemed not necessary for a full understanding of the principles of the present invention since the general structure and operation are well known to those skilled in the art. Furthermore, while the engine depicted is of a turbojet variety, it should be understood that the invention is applicable to any apparatus utilizing a continuous fluid flow combustion system; for example, aircraft turbofan, turboprop, turboshaft engines, and land based engines and the like.

It should be stated that the elements of the gas turbine engine 10 depicted in FIG. 1, that is to say the compressor 14, diffuser 22, combustor 30 and turbine 32, are generally annular in configuration and extend circumferentially about engine axis or centerline X—X such that the flow of air and eventually hot gases of combustion flow through an annular path circumscribing the axis X—X. Accordingly, the term "radially", when used herein, shall mean a direction generally radial with respect to engine centerline X—X. The term "axially" shall mean a direction generally along the engine centerline X—X and the term "circumferentially" shall mean a direction extending generally circumferentially about centerline X—X.

Figure 2:
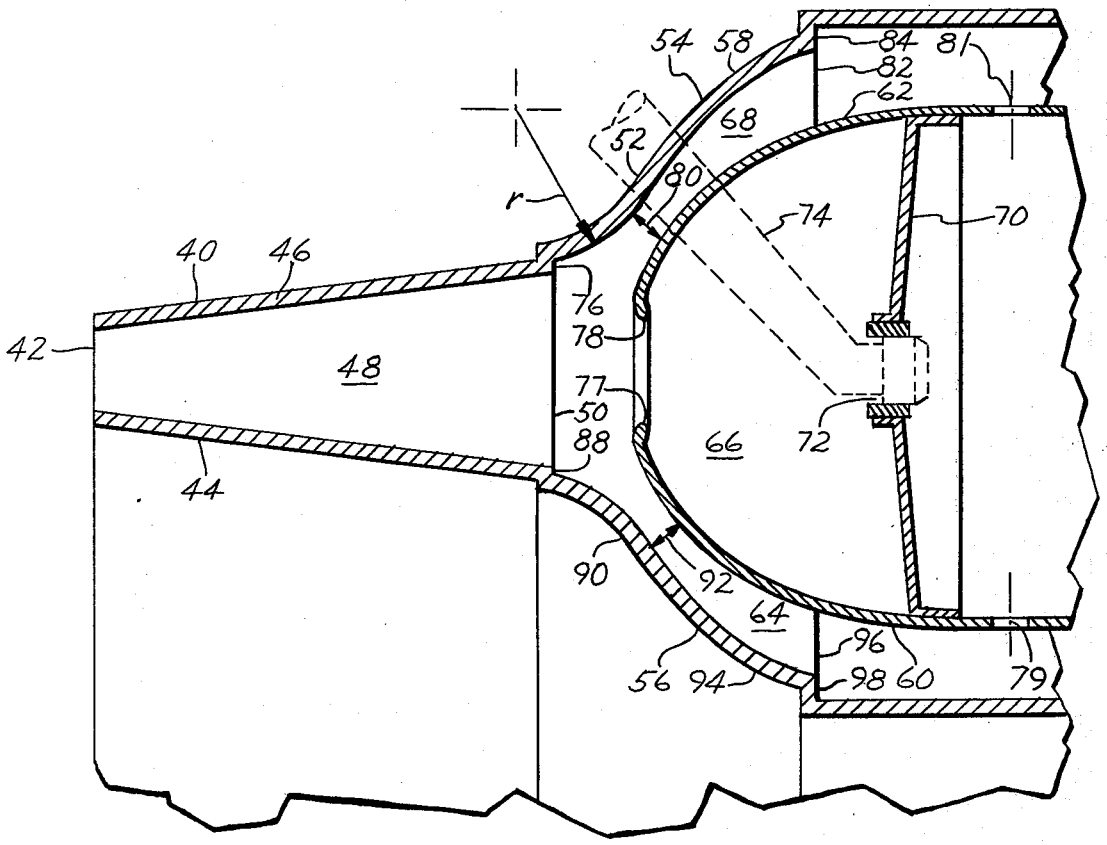
FIG. 2 is an enlarged schematic representation of a portion of the engine depicted in FIG. 1.

Referring now to FIG. 2, a schematic cross-sectional view of apparatus comprising the present invention is depicted wherein diffusing means are comprised of diffuser 22 and a portion of combustor 30. First diffusing means in the form of a first diffuser section 40 is adapted to receive a pressurized fluid, compressed air, from compressor 14 through inlet 42 disposed at the forward end of diffusing section 40. First diffuser section 40 comprises inner and outer axially and circumferentially extending wall portions 44 and 46, respectively, radially spaced apart from each other and diverging in the direction of fluid flow to define a first, annular axially-extending diffusing flow path 48 therebetween circumscribing the engine centerline X—X. Pressurized fluid, discharged from compressor 14, exhibits an extremely high fluid velocity and hence, the dynamic head, or in other words the dynamic pressure of the fluid attributable to the velocity of the fluid, is considerable. For this reason, pressurized fluid, entering inlet 42 at a first velocity, is decelerated or expanded in first diffuser section 40, by virtue of the divergence of flow path 48, until the velocity of the fluid at a location proximate the exit 50 of diffuser section 40 has been reduced in magnitude to a second velocity.

Pressurized fluid flowing through diffusing section 40 accumulates a fluid boundary layer on walls 44 and 46. The thickness of the boundary layer progressively increases as diffusing section 40 is traversed in the downstream direction. Accumulation of the fluid boundary layer reduces the effective cross-sectioned flow area of diffusing section 40 so that, at exit 50, the boundary layer thickness and the reduced effective flow area significantly inhibit further conversion of the fluid dynamic head into static pressure. As will hereinafter be described, one aspect of the present invention relates to providing means for reducing the thickness of the boundary layer accumulated on the walls of diffuser 40 proximate exit 50.

Downstream of first diffusing section 40 the present invention provides means, in the form of fluid accelerating section 52, for accelerating the pressurized fluid and additional diffusing means, in the form of second fluid diffusing section 54, for further decelerating and diffusing the pressurized fluid. Accelerating section 52 and second diffusing section 54 are formed by elements of combustor 30 in a manner now to be described.

Combustor 30 is comprised of inner and outer circumferentially and axially inner and outer wall portions 44 and 46 respectively, of first diffusing section 40. Combustor 30 is further comprised of a pair of spaced apart inner and outer, circumferentially and axially extending, linear portions 60 and 62, respectively, disposed between combustor wall portions 56 and 58. Wall portions 56 and 58 and liners 60 and 62 cooperate to define three concentric flow paths 64, 66 and 68 for receiving the flow of pressurized fluid from first diffusing section 40. Radially inner flow path 64 and radially outer flow path 68 are adapted to provide air for cooling the liner portions 60 and 62 and to provide dilution air through liner apertures 79 and 81 to support complete combustion within centralized flow path or combustion chamber 66 of combustor 30. Liners 60 and 62 are supported in the combustor and are interconnected at their forward ends by a generally radially extending annular member 70 having a plurality of centrally spaced openings 72 adapted to receive a plurality of fuel nozzles 74 (only one of which is depicted in phantom in FIG. 2). Nozzles 74 are supplied in a conventional manner with fuel to support combustion. The forward upstream ends of liners 60 and 62 terminate in radially spaced apart lips 77 and 78, respectively. The combustor 30 as depicted and described herein is of the annular type but it should be understood that the present invention is equally applicable to the can or cannular type.

One aspect of the present invention relates to turning a portion of the fluid flowing through exit 50, of first diffuser 40, and into flow paths 64 and 68. This aspect will now be discussed along with the previously mentioned feature relating to the reduction or elimination of the boundary layer thickness accumulated by the pressurized fluid. The description of these aspects of the invention will be described with reference to flow path 68. It should be understood, however, that the same principles and structure described with respect to flow path 68 are applicable to, and found in, flow path 64.

As earlier stated liner 62 cooperates with outer wall portion 58 to define an annular flow path 68. Flow path 68 is generally oriented to direct air for cooling and dilution purposes radially outward of liner 62 and for that purpose is oriented such that the distance of the flow path 68 to the engine centerline X—X increases as the flow path is traversed in the direction of fluid flow. This orientation necessitates a turning of the fluid as it exits first diffuser section 40. Additionally, the fluid must shed its boundary layer in order that additional conversion of fluid dynamic head to static pressure might occur most efficiently. In order to accomplish these purposes, stepped means are provided for turning the fluid stream from a first direction to a second direction and for reducing the boundary layer thickness of the fluid. More specifically, combustor outer wall portion 58, which is disposed axially adjacent wall portion 46 of diffusing section 40, is connected to wall portion 46 by a radially extending step 76. Step 76 disposed between first diffuser section 40 and accelerating section 52, faces axially in the direction of fluid flow and establishes a very localized area of low pressure immediately adjacent step 76. The pressure in the localized area is lower than the pressure of the pressurized fluid at points remote from wall 46. Consequently, the fluid is biased or redirected toward the localized area of reduced pressure and turning of the fluid toward the flow path 68 is thereby facilitated. Additionally, the presence of step 76 establishes a localized area wherein the pressurized fluid is momentarily out of contact with the wall 58 confining the flow path 68. In this localized area, the boundary layer fluid is out of contact with the frictional forces associated with the flow path wall 58. However, while not in contact with the wall 58, the boundary layer fluid is influenced by viscous contact with the mainstream of pressurized fluid and a reduction in the thickness of the boundary layer is thereby accomplished. The amount of reduction in the boundary layer thickness is a function of various flow parameters and, in many situations, the presence of step 76 may entirely eliminate the fluid boundary layer. It should be emphasized that step 76 is small relative to the radial height of the stream entering passage 68 to insure that a sudden substantial increase in flow area does not occur and that a significant instantaneous reduction of the dynamic head is not effected at this location.

Immediately downstream of step 76, liner 62 and outer wall portion 58 cooperate to define fluid accelerating section 52 for accelerating the pressurized fluid from the second to a third velocity. More specifically liner 62 and wall portion 58 define an axially extending annular portion of flow path 68 and converge toward each other in the direction of fluid flow to progressively reduce the cross-sectional area of flow path 68 until minimum throat area 80 is established. Consequently, fluid flowing through the converging section of flow path 68 is accelerated until the velocity of the fluid reaches a third velocity at throat area 80. The velocity of the fluid at throat 80 has a magnitude greater than the magnitude of the aforementioned second velocity of the fluid at exit 50 of first diffuser section 40. Since acceleration of fluid section 52 further reduces the thickness of the boundary layer of the pressurized fluid, the fluid stream is in condition to accomplish additional diffusing and additional conversion of the dynamic head into static pressure.

Immediately downstream of throat area 80 of accelerating section 52, liner 62 and outer wall portion 58 cooperate to form second diffusing section 54. More specifically, liner 62 and wall portion 58 define an axially extending annular portion of flow path 68 and diverge away from each other in the direction of fluid flow to progressively increase the cross-sectional area of flow path 68. Consequently, fluid is decelerated from the aforementioned third velocity to a fourth velocity at exit 82 of diffusing section 52. The fourth velocity exhibits a magnitude less than the aforementioned second velocity of the fluid at exit 50.

Fluid velocity at exit 82, will be substantially lower than the velocity of the fluid exiting compressor 14 and accordingly is in condition for a sudden expansion to convert a portion of the remaining dynamic head into static pressure. For this purpose outer wall portion 58 includes sudden expansion means in the form of a large instantaneous increase in cross-sectioned area of flow path 68 downstream of the second diffusion section 54.

The large instantaneous increase in cross-sectional area is accomplished by providing a large radially extending step 84, large in the sense that step 84 is substantially larger than step 76, in outer wall portion 58. The presence of step 84 permits a sudden expansion of the fluid flowing out of exit 82 thereby reducing the velocity of the fluid to a fifth velocity having a magnitude less than the aforementioned fourth velocity.

By way of example a typical advanced gas turbine engine may deliver pressurized fluid from its compressor at a Mach. No. of approximately 0.43. The present invention is well adapted to convert the dynamic head associated with this high initial fluid velocity into static pressure. Fluid received at the first diffusing section 40 is decelerated to a second velocity having a Mach. No. of approximately 0.23 at exit 50. With step 76 present, a portion of the fluid is turned and stripped of some, if not all, of its boundary layer. The fluid is then accelerated in accelerating section 52 to a third velocity having a Mach. No. of approximately 0.3 at throat 80. Second diffusing section 54 then further diffuses and decelerates the pressurized fluid velocity of approximately 0.12 Mach. No. at exit 82 of second diffusing section 54. Thereupon, the fluid undergoes a rapid dump or expansion as herein before described.

Another aspect of the present invention will now be discussed. As earlier stated the step 76 facilitates turning of the stream of fluid into flow path 68. It is important that wall portion 58 immediately downstream of step 76 exhibit the proper curvature to avoid flow separation of the pressurized fluid from wall portion 58. Flow separation will establish turbulence which reduces the efficiency of diffuser 22. It has been found that, if the radius of curvature of wall portion 52 immediately downstream of step 76 is greater than 1.72 of the height of the fluid desired to be turned, separation will not occur.

As earlier stated, the present invention has been described with respect to flow path 68 but is equally applicable with respect to flow path 64. While the principles of the invention will not be repeated with respect to flow path 64, it should be understood step 88, accelerating section 90, throat area 92, diffusing section 94, exit 96 and step 98 associated with flow path 64 correspond, respectively, to step 76, accelerating section 52, throat area 80, diffusing section 54, exit 82 and step 84 associated with flow path 68.

From the foregoing, it is now apparent that apparatus for converting the dynamic head of a flowing fluid into static pressure has been provided which is well adapted to fulfill the aforestated objects of the invention and though only a single embodiment of the invention has been described for purposes of illustration, it should be understood that other equivalent forms of the invention are possible within the scope of the appended claims.

Having thus described the invention, what is claimed as new and useful and desired to be secured by U.S. Letters Patent is:

1. Diffusing apparatus for converting the dynamic head of a flowing stream of fluid discharged from a compressor into static pressure, said apparatus comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity; and second controlled diffusing means disposed downstream of said accelerating means for decelerating said fluid from said third velocity to a fourth velocity having a magnitude less than the magnitude of said second velocity.

2. Diffusing apparatus for converting the dynamic head of a flowing stream of fluid discharged from a compressor into static pressure, said apparatus comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity; and second diffusing means disposed downstream of said accelerating means for decelerating said fluid from said third velocity to a fourth velocity having a magnitude less than the magnitude of said second velocity;

means disposed downstream of said second diffusing means for suddenly expanding said fluid to reduce the velocity of said fluid to a fifth velocity having a magnitude less than the magnitude of said fourth velocity.

3. Diffusing apparatus for converting the dynamic head of a flowing stream of fluid discharged from a compressor into static pressure, said apparatus comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity; and second diffusing means disposed downstream of said accelerating means for decelerating said fluid from said third velocity to a fourth velocity having a magnitude less than the magnitude of said second velocity;

means disposed between said first diffusing means and said accelerating means for turning said fluid stream from a first direction to a second direction and for reducing the boundary layer thickness accumulated by said fluid while flowing in said first diffusing means.

4. The apparatus as set forth in claim 3 further comprising:

means disposed downstream of said second diffusing means for suddenly expanding said fluid to reduce the velocity of said fluid to a fifth velocity having a magnitude less than the magnitude of said fourth velocity.

5. Diffusing apparatus for converting the dynamic head of a flowing stream of fluid discharged from a compressor into static pressure, said apparatus comprising:

first diffusing means receiving said fluid from said compressor for decelerating said fluid from a first velocity to a second velocity;

second diffusing means disposed downstream of said first diffusing means for decelerating said fluid to a velocity having a magnitude less than the magnitude of said second velocity;

stepped means disposed between said first diffusing means and said second diffusing means for turning said fluid stream from a first direction to a second direction for reducing the boundary layer thickness accumulated by said fluid while flowing in said first diffusing means; and means for suddenly expanding said fluid, said first and second diffusing means decelerating said fluid prior to sudden expansion of said fluid.

6. In a gas turbine engine having an annular diffuser for receiving pressurized fluid from a compressor, said engine further having an annular combustor including an annular combustion chamber to which said fluid is directed from the diffuser to support combustion, said diffuser and said combustor each extending circumferentially about an axial centerline associated with said engine, the invention comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity;

second controlled diffusing means disposed downstream of said accelerating means for decelerating said fluid from said third velocity to a fourth velocity having a magnitude less than the magnitude of said second velocity; and means for admitting said fluid discharged from said second diffusing means to said combustion chamber.

7. The invention as set forth in claim 6 herein said first diffusing means comprises:

an axially extending flow path circumscribing said centerline, said flow path having a cross-sectional area which increases in the direction of flow of said fluid.

8. The invention as set forth in claim 7 wherein said accelerating means comprises:

an axially extending flow path circumscribing said centerline, said flow path having a cross-sectional area which decreases in the direction of flow of said fluid.

9. The invention as set forth in claim 8 wherein said second diffusing means comprises:

an axially extending flow path circumscribing said centerline, said flow path having a cross-sectional area which increases in the direction of flow of said fluid.

10. In a gas turbine engine having an annular diffuser for receiving pressurized fluid from a compressor, said engine further having an annular combustor including an annular combustion chamber to which said fluid is directed from the diffuser to support combustion, said diffuser and said combustor each extending circumferentially about an axial centerline associated with said engine, the invention comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity;

second diffusing means disposed downstream of said accelerating means for decelerating said fluid from said third velocity to a fourth velocity having a magnitude less than the magnitude of said second velocity; and means for admitting said fluid discharged from said second diffusing means to said combustion chamber;

means disposed downstream of said second diffusing means for suddenly expanding said fluid to reduce the velocity of said fluid to a fifth velocity having a magnitude less than the magnitude of said fourth velocity.

11. In a gas turbine engine having an annular diffuser for receiving pressurized fluid from a compressor, said engine further having an annular combustor including an annular combustion chamber to which said fluid is directed from the diffuser to support combustion, said diffuser and said combustor each extending circumferentially about an axial centerline associated with said engine, the invention comprising:

first diffusing means receiving said fluid from said compressor for decelerating said fluid from a first velocity to a second velocity;

means disposed downstream of said first diffusing means for accelerating said fluid to a third velocity having a magnitude greater than the magnitude of said second velocity;

second diffusing means disposed downstream of said accelerating means for decelerating said fluid from said third velocity to a fourth velocity having a magnitude less than the magnitude of said second velocity; and means for admitting said fluid discharged from said second diffusing means to said combustion chamber;

means disposed between said first diffusing means and said accelerating means for turning said fluid stream from a first direction to a second direction and for reducing the boundary layer thickness accumulated by said fluid while flowing in said first diffusing means.

12. The invention as set forth in claim 11 further comprises:

means disposed downstream of said second diffusing means for suddenly expanding said fluid to reduce the velocity of of said fluid to a fifth velocity having a magnitude less than the magnitude of said fourth velocity.

13. In a gas turbine engine having an annular diffuser for receiving pressurized fluid having a dynamic head from a compressor, said engine further having an annular combustor including a combustion chamber to which said fluid is directed from the diffuser to support combustion, said diffuser and combustor each extending circumferentially about an axial centerline associated with said engine, the invention comprising:

first diffusing means receiving said fluid from said compressor for decelerating said fluid from a first velocity to a second velocity;

second diffusing means disposed downstream of said first diffusing means for decelerating said fluid to a velocity having a magnitude less than the magnitude of said second velocity; and stepped means disposed between said first diffusing means and said second diffusing means for turning said fluid stream from a first direction to a second direction and for reducing the boundary layer thickness accumulated by said fluid while flowing in said first diffuser means said stepped means providing for turning of said fluid stream and reduction of said boundary layer thickness without effecting a significant instantaneous reduction in said dynamic head; and means for admitting said fluid discharged from said second diffusing means to said combustion chamber.

14. The invention as set forth in claim 13 wherein said first diffusing means comprises an axially extending flow path circumscribing said centerline, said flow path having a cross-sectional area that increases in the direction of flow of said fluid.

15. The invention as set forth in claim 14 wherein said second diffusing means comprises an axially extending flow path circumscribing said centerline, said flow path having a cross-sectional area that increases in the direction of flow of said fluid.

16. The invention as set forth in claim 15 wherein said turning and boundary layer reducing means comprises step means disposed between said first and second diffusing means.

17. In a gas turbine engine having an annular diffuser for receiving pressurized fluid having a dynamic head from a compressor and an annular combustor to which said fluid is directed from the diffuser to support combustion, said diffuser and said combustor each extending circumferentially about an axial centerline associated with said engine, the invention comprising:

a first diffusing section receiving fluid flowing through said compressor, and including radially inner and outer axially extending wall portions radially spaced apart from each other and diverging in the direction of flow of said fluid to define a first diffusing flow path therebetween;

inner and outer combustor wall portions disposed respectively axially adjacent to the inner and outer wall portions of said first diffuser section;

a radially extending step connecting one of said combustor wall portions to one of said first diffusing wall portions, said step comprised of a relatively small height to insure that a significant instantaneous reduction in said dynamic head is not effected; and a pair of spaced apart liners disposed between said combustor wall portions and defining three concentric flow paths, one of said liners cooperating with one of said combustor portions to define a second diffusing section in one of said concentric flow paths downstream of said first diffusing section.

18. The invention as set forth in claim 17 wherein said one of said combustor walls and said one of said liners further cooperate to define an accelerating section upstream of said second diffusing section.

* * * * *